United States Patent [19]

Kondo et al.

[11] 4,280,031

[45] Jul. 21, 1981

[54] ILLUMINATING TYPE PUSH-BUTTON SWITCH DEVICE

[75] Inventors: Shiro Kondo; Yasuo Takii, both of Furukawa, Japan

[73] Assignee: Alps Electric Co., Ltd., Tokyo, Japan

[21] Appl. No.: 107,525

[22] Filed: Dec. 27, 1979

[30] Foreign Application Priority Data

Dec. 28, 1978 [JP] Japan ..... 53-179707[U]

[51] Int. Cl.[3] ..... H01H 9/16

[52] U.S. Cl. ..... 200/314; 200/311

[58] Field of Search ..... 200/309, 310, 311, 312, 200/313, 314, 340, 317; 116/DIG. 28

[56] References Cited

U.S. PATENT DOCUMENTS

| | | | |
|---|---|---|---|
| 2,440,063 | 4/1948 | Andrews | 200/314 |
| 2,766,373 | 10/1956 | Gebel | 200/314 |
| 3,169,506 | 2/1965 | Morris | 200/314 |
| 3,377,452 | 4/1968 | Bock et al. | 200/314 |
| 3,715,548 | 2/1973 | Schadow | 200/311 |
| 4,031,849 | 6/1977 | Mehta | 200/309 |
| 4,044,214 | 8/1977 | Rayburn et al. | 200/311 |
| 4,129,766 | 12/1978 | Miyata et al. | 200/340 |

FOREIGN PATENT DOCUMENTS

| | | | |
|---|---|---|---|
| 2434739 | 1/1976 | Fed. Rep. of Germany | 200/314 |

*Primary Examiner*—John W. Shepperd

*Attorney, Agent, or Firm*—Guy W. Shoup; Gerard F. Dunne

[57] ABSTRACT

An assembly of illuminated push button switches includes a plurality of push members operatively engaged with the operating rods of corresponding push button switches. The push members have display windows associated with respective shutter members, and a single light source is arranged behind the shutter members, whereby the illuminated displays of the plurality of switches can be made with the single light source.

8 Claims, 5 Drawing Figures

ILLUMINATING TYPE PUSH-BUTTON SWITCH DEVICE

Figure 1:
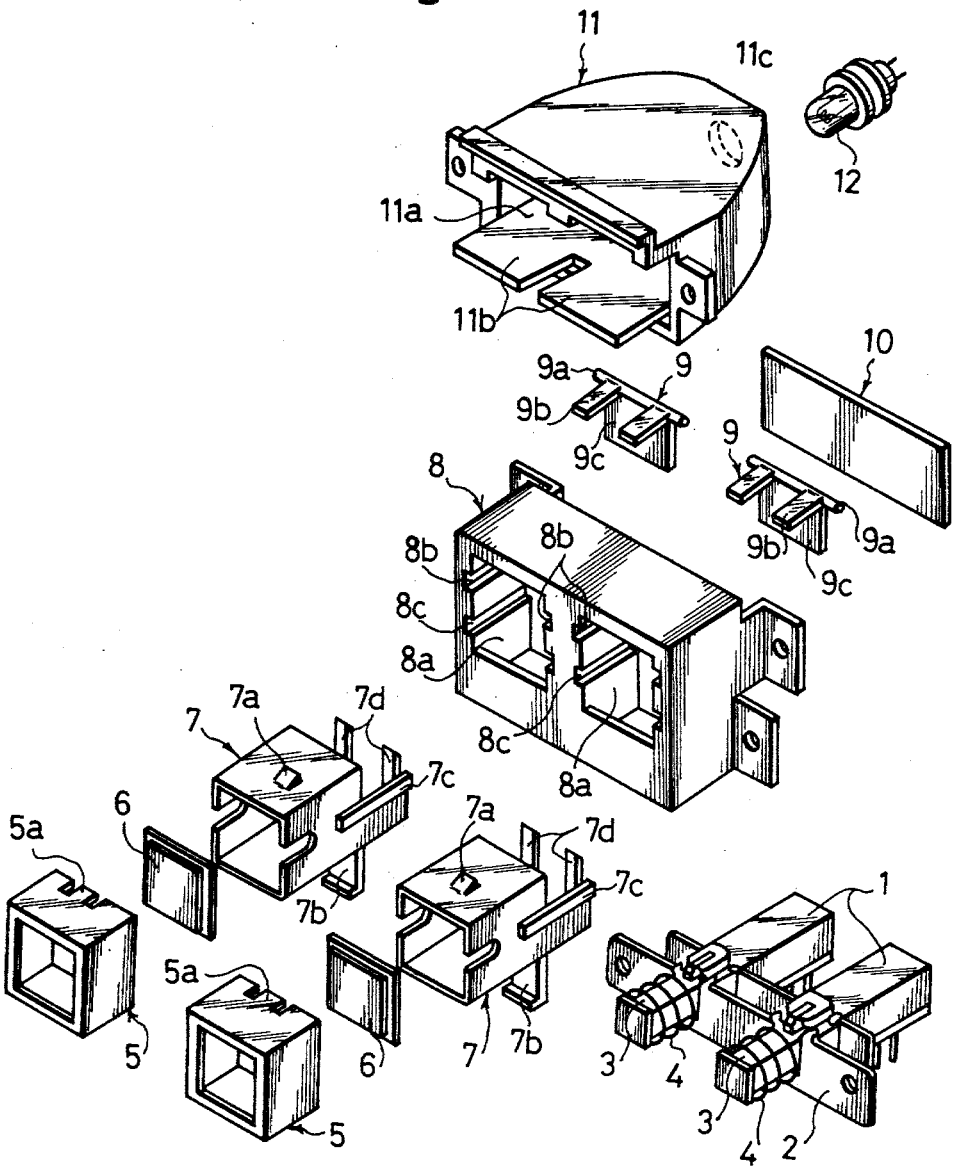

The present invention relates to an assembly of illuminated push button switches.

Many known assemblies of illuminated push button switches have a different lamp associated with each push button and the lamps are lit by depressing the respective push button. Such assemblies, however, are disadvantageous in that they are costly because a number of lamps corresponding to the number of push button switches is required. Another disadvantage is that, since the lamp does not light up till the depression of the push button, the position of the push button is difficult to discern in a dark place, for example, in the interior of an automobile.

It is accordingly an object of the present invention to provide an assembly of push button switches wherein the status of a plurality of push button switches will be indicated by use of a single light source.

Another object of the present invention is to provide such an assembly which can indicate the status of the respective switches even in a dark place.

Still another object of the present invention is to provide such an assembly which can be constructed by utilizing a conventional array of push button switches.

According to the present invention, an assembly of push button switches includes a frame carrying an array of push button switches each having an operation rod slidable within the frame for changing the status of the respective switch. A plurality of push members are carried slidably by the frame and these push members are each engaged with a respective one of the operation rods for unitary movement therewith. Preferably, such engagement is accomplished by an integral arm portion protruding from the respective push members and abutting against an associated operation rod. The push members also have, at their forward end portions, a respective display window for transmitting light and preferably formed of a light transmitting material such as an acrylic resin. A light source is held rearwardly of the frame and a plurality of shutter members are each held pivotally to said frame at a location between this light source and their respective one of the display windows. Respective means are thus associated with each push member for pivoting the respective shutter member out of the path of the light to the respective display window during depression of the push member, and preferably, these pivoting means include at least one post portion extending rearwardly from the respective push member.

The push members may each be constructed of a hollow body having an opening at each end thereof and that the display windows are each fixed in the forward opening of the respective push member. The shutter members may each include a pivot bar supported by the frame and a shutter plate depending from this pivot bar. At least one leg portion also extends from this pivot bar and is in orthogonal relation to the shutter plate whereby during depression of the respective push member, each post will pivot the respective shutter plate upwardly, while each respective leg portion drops behind the respective post so as to be pivoted thereby to re-position the shutter plate during return of the push member. These shutter plates are preferably formed from a light transmitting material which may also be an acrylic resin.

Further objects and advantages of the present invention will become apparent from the following description of the preferred embodiments taken with reference to the accompanying drawings.

Figure 2:
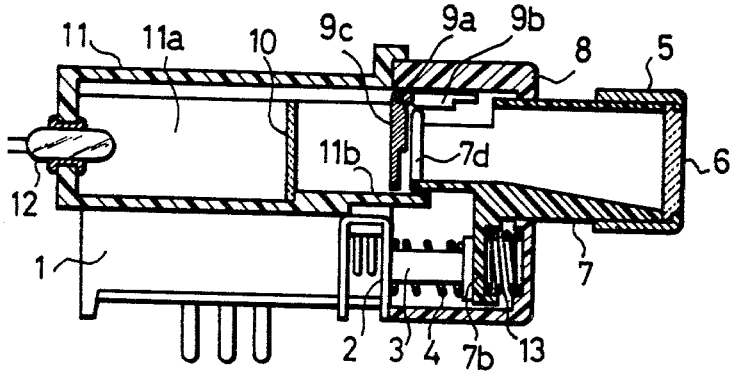
Figure 2:
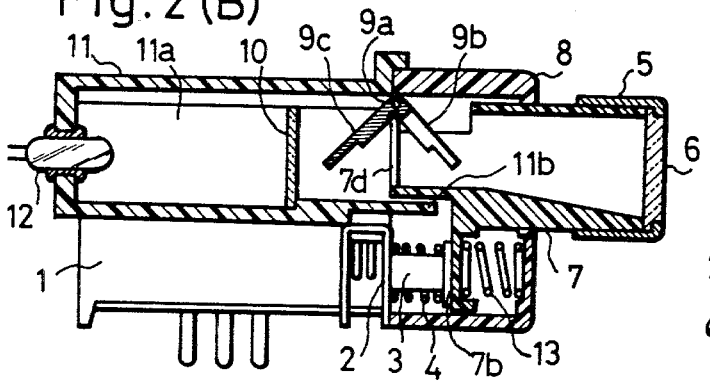
Figure 3:
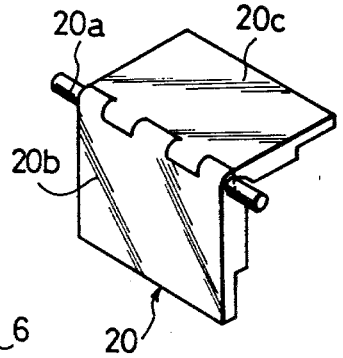
Figure 2:
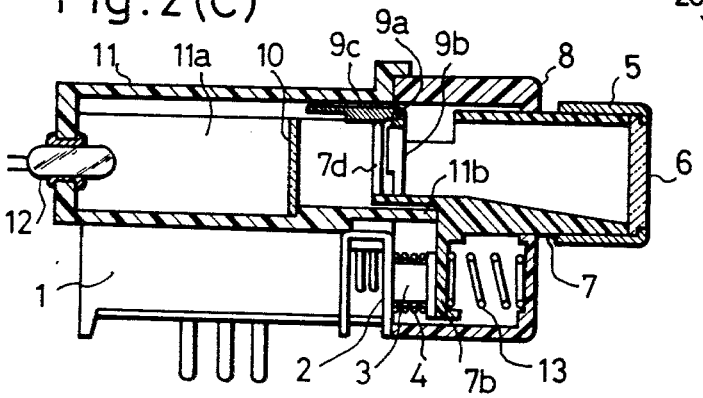

FIG. 1 is an exploded perspective view of an assembly of push button switches embodying the present invention, FIGS. 2A, 2B and 2C are sectional side elevations of essential portions for explaining the operation of the embodiment shown in FIG. 1, and FIG. 3 is a perspective view showing a modified embodiment of a shutter member.

Referring to FIG. 1, an array of conventional push button switches 1 is mounted to a metallic mounting plate 2. Each switch 1 includes an operation rod 3 made from a synthetic resin or the like, and having a coiled spring 4 held therearound for biasing the operation rod into its return position outward of the switch body.

Each switch 1 has associated therewith a respective push member 7 molded from a synthetic resin and held slidably by a frame 8 made of synthetic resin or the like. The push members 7 are each provided with upward projections 7*a*, an arm portion 7*b* depending integrally from the push member, guide strips 7*c* and 7*c*, and post portions 7*d* and 7*d*. The openings 8*a* of the frame 8 receive the respective push members 7 and guide slots 8*b* provided in the side walls of each opening 8*a* receive the guide strips 7*c* of the respective push member. The push members 7 are thus each a generally hollow body having openings at each end. The forward opening of each push member is fitted with a cap 5 made of synthetic resin or the like and having depending engaging portions 5*a* adapted to snap over the projections 7*a* of the push member. Each cap 5 carries a display window 6 formed of a light transmitting material such as an acrylic resin having any desired color, or it may be clear.

Fitted pivotally within the frame 8 are respective shutter members 9 for each push member 7. The shutter members 9 each consist of a pivot bar 9*a* held pivotally by the frame 8, leg portions 9*b* and a shutter plate 9*c* made of a light transmitting material such as acrylic resin and extending from the pivot bar in a generally orthogonal relation with the leg portions 9*b*. Fitted in the frame 8 at a location behind the shutter members is a diffusing plate 10 making light from a lamp 12 more uniform. The lamp 12 is held in an opening 11*c* in a lamp cover 11 having a partition plate 11*b* protruding forwardly.

Assembly of the embodiment illustrated in FIG. 1 is undertaken by first attaching the caps 5 carrying display windows 6 to the respective push member 7 by bringing the engaging portions 5*a* of the caps into engagement with the projections 7*a* of the respective push members 7. The resultant push members are then inserted through the openings 8*a* in the frame 8 from the rear side thereof in such a manner that the guide strips 7*c* fit in the guide slots 8*b*. Thereafter, respective coiled springs 13 shown in FIGS. 2A–2C are interposed between the arm portions 7*b* of the push members 7 and the inner wall of the frame 8. The array of switches 1 carried by the mounting plate 2 are then attached with screws to the ears carried on the lower portion of the frame in a manner so that the operating rods 3 of the switches 1 abut against respective arm portions 7*b* of the push members 7. The returning coiled springs 4 have a spring pressure greater than that of the coiled springs 13. Subsequently, the pivot bars 9*a* of the shutter members 9 are located in respective notches (not shown) provided in the frame 8 so that the shutter plates 9c may oppose the post portions 7d of respective push members 7. The lamp cover 11 on which the lamp 12 is installed is attached with screws to the ears carried by the upper portion of the frame 8. At this time, the partition plate 11b is fitted in grooves 8c provided in the side walls of the openings 8a of the frame 8 to complete assembly.

The illuminated assembly of push button switches of the present invention thus assembled operates as will now be described with reference to one switch. FIG. 2A illustrates the state in which the push member 7 is not depressed. Since the lamp 12 is lit at all times, the light of the lamp 12 passes through the shutter plate 9c as well as the display window. The quantity of the light noticed by viewing the window is reduced considerably and the indication at the display plate 6 is that of a dim light. When the push member 7 is depressed in this state, the operation rod 3 of the switch 1 is pressed inwardly against the spring pressure of the coiled spring 4 by the arm portion 7b of the push member 7, and the status of the switch 1 is changed. Simultaneously, the shutter member 9 is turned about the pivot bar 9a by the movement of the post portions 7d of the push member 7. As a result, the shutter plate 9c having been located in the path of the light, moves out of the path, and the leg portions 9b are turned into the path in a position behind the post portions (refer to FIG. 2C). In this state, the light of the lamp passes through only the display window 6. Therefore, the quantity of light noticed by viewing the window is greater than in the state of FIG. 2A, and the indication of the display window 6 is considerably bright. FIG. 2B illustrates the state in which the switch is being changed-over as described above.

In the embodiment of the present invention, the shutter member 9 is provided with the single shutter plate 9c, and the operation of the switch is displayed owing to the difference of brightness based on the change of the quantity of the light passing through the display window. However, the display can also be made on the basis of a change in the color tone by depositing a light-transmitting colored coating onto the shutter plate 9 in such a manner that before the depression of the push member 7, the operation of the switch is displayed in a compound color between the color of the display window 6 and the color of the shutter plate 9c, whereas after the depression of the push member and the turning of the shutter member 9, the operation of the switch is displayed in the color of the display window 6. In addition, a shutter member 20 as shown in FIG. 3 may well be adopted. In this case, two shutter plates 20b and 20c are disposed at right angles on a pivot bar 20a, and they are colored in different colors. By way of example, when the shutter plates 20b and 20c are respectively colored in red and green and the display plate 6 is colored in yellow, the color tones of orange and yellow-green can be produced in the display.

As set forth above, the present invention provides a display by the use of a single lamp for a plurality of switches. Therefore, the number of lamps can be reduced as compared with that in the prior art switch devices which require one lamp for each switch, so that the assembly of the present invention is suitable for use in automobiles. Since the lamp is normally lit and the display owing to any light is always made, the status of the switch is clear even in a dark place. In addition, displays based on various color tones are possible by coloring a display plate and a shutter plate in various colors. As the switch portion, conventional push button switches can be used without any change, so that the assembly of the present invention is inexpensive.

What is claimed is:

1. An assembly of push button switches having push members continually illuminated, including a frame carrying an array of push button switches each having an operation rod slidable therein for changing the status of the respective switch, a plurality of push members carried slidably by said frame, said push members being each engaged with a respective one of said operation rods for unitary movement therewith and having at its forward end portion a respective display window for transmitting light, a light source held rearwardly of said frame, a plurality of shutter members each held pivotally to said frame, said shutter members including a shutter plate formed by a light transmitting material and held at a location between said light source and a respective one of said display windows, a light diffusing plate extending between said light source and each said shutter member to provide a uniform amount of light to each display window of every non-depressed push member, and respective means associated with each said push member for pivoting the respective shutter member out of the path of light to the respective display window during depression of said push member to increase the amount of light thereto.

2. An assembly according to claim 1, said push members each being constructed of a hollow body having an opening at each end thereof, said display windows each being fixed in the forward opening of each push member.

3. An assembly according to claim 1 or 2, each said push member having an integral arm portion protruding therefrom and abutting against an associated operation rod.

4. An assembly according to claim 1 or 2, each said pivoting means including at least one post portion extending rearwardly from said respective push member.

5. An assembly according to claim 4, said shutter members each including a pivot bar supported by said frame, a shutter plate depending from said pivot bar and at least one leg portion extending from said pivot bar in orthogonal relation to said shutter plate whereby during depression of the respective push member, each post will pivot the respective shutter plate upwardly while each respective leg portion drops behind the respective post so as to be pivoted thereby to re-position the shutter plate during return of the push member.

6. An assembly according to claim 1, said display plates each being formed from a light transmitting material.

7. An assembly according to claim 6, said material being an acrylic resin.

8. An assembly according to claim 1 said material of said shutter plates being an acrylic resin.

* * * * *